US009464867B2

(12) United States Patent
Thompson

(10) Patent No.: US 9,464,867 B2
(45) Date of Patent: Oct. 11, 2016

(54) UNIVERSALLY CONFIGURABLE HOLSTER

(71) Applicant: The Fechheimer Brothers Company, Cincinnati, OH (US)

(72) Inventor: Jesse Thompson, North Bend, WA (US)

(73) Assignee: The Fechheimer Brothers Company

( * ) Notice: Subject to any disclaimer, the term of this patent is extended or adjusted under 35 U.S.C. 154(b) by 0 days.

(21) Appl. No.: 14/590,340

(22) Filed: Jan. 6, 2015

(65) Prior Publication Data

US 2015/0192387 A1 Jul. 9, 2015

Related U.S. Application Data

(60) Provisional application No. 61/923,836, filed on Jan. 6, 2014.

(51) Int. Cl.
*F41C 33/02* (2006.01)

(52) U.S. Cl.
CPC ..... *F41C 33/0209* (2013.01); *F41C 33/0263* (2013.01)

(58) Field of Classification Search
CPC ..... F41C 33/0209; F41C 33/0263
USPC ..... 224/238, 911, 250, 242–243, 246, 901, 224/901.2, 930
See application file for complete search history.

(56) References Cited

U.S. PATENT DOCUMENTS 2,859,551 A * 11/1958 Buchanan ..... F41A 17/54 42/70.07
3,977,582 A * 8/1976 McMahon ..... A45C 11/00 224/246
4,022,361 A * 5/1977 Devlin ..... A45F 5/021 224/192
4,256,243 A * 3/1981 Bianchi ..... F41C 33/046 224/244
4,258,871 A * 3/1981 McMahon ..... F41C 33/046 224/192
4,395,837 A * 8/1983 Durnal ..... F41A 17/54 42/70.11
4,500,019 A * 2/1985 Curley, Jr. ..... A45F 5/00 224/222
4,509,667 A * 4/1985 Meldrum ..... A45F 5/00 224/222
4,644,676 A * 2/1987 Stern ..... F41A 17/54 224/911
4,787,540 A * 11/1988 Barry ..... F41C 33/0236 224/192
4,966,321 A * 10/1990 Outlaw ..... A45F 5/02 224/674

(Continued)

*Primary Examiner* — Nathan J Newhouse
*Assistant Examiner* — Jennifer N Zettl
(74) *Attorney, Agent, or Firm* — Wood Herron & Evans LLP

(57) ABSTRACT

Disclosed is a holster configurable and reconfigurable to hold different objects. The holster includes a first flexible sheet with first and second surfaces and an aperture therein. One surface of the sheet is substantially covered with one fastener component of a hook-and-loop fastener material and the other surface is substantially covered with the other fastener component of a hook-and-loop fastener material. A retention member is attachable over at least a portion of the aperture and has a friction surface that, through the aperture, contacts a surface of the object being held in the holster. The holster may include an attachment panel for repositionably attaching the holster to a surface of a separate article.

12 Claims, 15 Drawing Sheets

(56) References Cited

U.S. PATENT DOCUMENTS 5,526,924 A * 6/1996 Klutznick ..... A45C 11/04 206/5
D382,995 S * 9/1997 Hale ..... D3/215
5,711,469 A * 1/1998 Gormley ..... A45F 5/02 224/236
5,988,467 A * 11/1999 Brustein ..... A43B 3/0031 224/222
6,182,878 B1 * 2/2001 Racca ..... A45C 15/00 224/236
6,264,079 B1 * 7/2001 Skaggs ..... F41C 33/0236 224/193
6,330,961 B1 * 12/2001 Borja ..... A45C 1/04 224/221
6,364,187 B1 * 4/2002 Castellano ..... A45F 5/02 224/236
6,568,576 B1 * 5/2003 Godshaw ..... A45C 11/00 224/269
7,510,076 B2 * 3/2009 Yamada ..... A45C 9/00 206/316.2
7,810,683 B2 * 10/2010 Chan ..... A45F 5/00 224/221
8,308,033 B2 * 11/2012 Case ..... A45F 5/02 224/197
8,453,898 B2 * 6/2013 Ewins ..... A45F 5/02 224/675
2001/0022161 A1 * 9/2001 Macedo ..... A01K 27/004 119/796
2004/0079776 A1 * 4/2004 Bauer ..... A45F 5/02 224/269
2007/0205244 A1 * 9/2007 Hewes ..... A45F 5/02 224/674
2013/0119098 A1 * 5/2013 Stiefel ..... A45F 5/02 224/183

* cited by examiner

UNIVERSALLY CONFIGURABLE HOLSTER

RELATED APPLICATION

This application claims priority to and incorporates by reference the disclosure of U.S. Provisional Patent Application No. 61/923,836, filed Jan. 6, 2014.

FIELD OF THE INVENTION

This invention relates to holsters for articles and more specifically to holsters for weapons such as handguns, as well as for a wide variety of other articles, such as ammunition magazines, flashlights, tools and numerous other items used in the tactical field by military, law enforcement, utility and other persons, as well as for non-tactical use by other persons such as shooters, campers, and hikers.

BACKGROUND OF THE INVENTION

Holsters are typically designed either to fit a specific weapon, accessory, or other item, or are designed with wider tolerances to accommodate a variety of other items that are similar, but that vary in exact shape and size. Such universal-fit holsters thus function to hold or carry a variety of weapons, for example, by the same manufacturer or by multiple manufacturers where the weapons are perhaps somewhat similar in overall size but whose varying shape or features prevent one weapon from efficiently fitting into a holster specifically formed to fit another particular weapon.

Many applications require more positive or secure retention of the weapon or article therein to prevent its unintentional withdrawal or separation from the holster. Holsters designed for specific weapons or items provide significant retention, while "generic" holsters with more generous tolerances required for universal function with a variety of weapons do not or cannot provide the benefit of any significant degree of retention. This is particularly the case with "soft" holsters made of fabric or flexible material rather than more rigid materials.

One particular use of a holster is to provide a device for holding, for example, a weapon or other article in a backpack, fanny pack, carry bag, range bag, vest, clothing or the like. Typically, these are universal fit holsters which comprise at best a "pocket" or receptacle of relatively loose fit. A weapon usually rides in such a holster in a prescribed position for access when the backpack, fanny pack, carry bag, range bag, vest or clothing is opened or unfastened. Weapon or accessory holding devices in these uses, for example, may comprise only loose sleeves or elastic straps for holding the weapon. Inventory and warehousing constraints frequently and practically prevent the supply of a backpack, fanny pack, carry bag, range bag, vest or other clothing specific to the weapon where an internal holster includes a unit designed for only a specific weapon.

Accordingly, it is one benefit of this invention to provide a universally configurable holster which can be fit to a wide variety of weapons or articles, yet reapplied to other weapons of different sizes and features with the same retention characteristics and fit tolerances from weapon to weapon.

A further benefit of this invention is to provide a holster for use on a belt or in a backpack, fanny pack, carry bag, range bag, vest or clothing wherein the holster is configurable by the user to a variety of weapons or articles having varied sizes, shapes and features.

SUMMARY OF THE INVENTION

The present invention provides a holster configurable and reconfigurable to hold different objects. The holster includes a first flexible sheet with first and second surfaces and an aperture therein. One surface of the sheet is substantially covered with one fastener component of a hook-and-loop fastener material and the other surface is substantially covered with the other fastener component of a hook-and-loop fastener material. The sheet is formed into a sleeve of a size and shape to hold the object. A retention member is attachable over at least a portion of the aperture and has a friction surface that, through the aperture, contacts a surface of the object being held in the holster.

The holster may also include an attachment panel for repositionably attaching the holster to a surface of a separate article. A spacer, in the form of a roll of material, may be located within a folded over panel to provide a configurable offset from a surface on which the holster is mounted.

Similar configurable members can be applied for carrying other gear, including magazines, flash bangs, gas, spray, and many other components useful in a variety of industries. Other features, uses, configurations, and benefits will be apparent from a review of the detailed description, drawing figures, and claims, all of which form part of the present disclosure.

BRIEF DESCRIPTION OF THE DRAWING

Like reference numerals are used to indicate like parts throughout the various figures of the drawings, wherein:

FIG. 5I illustrates a friction member being configured to the holster; and

DETAILED DESCRIPTION OF THE INVENTION

Figure 1:
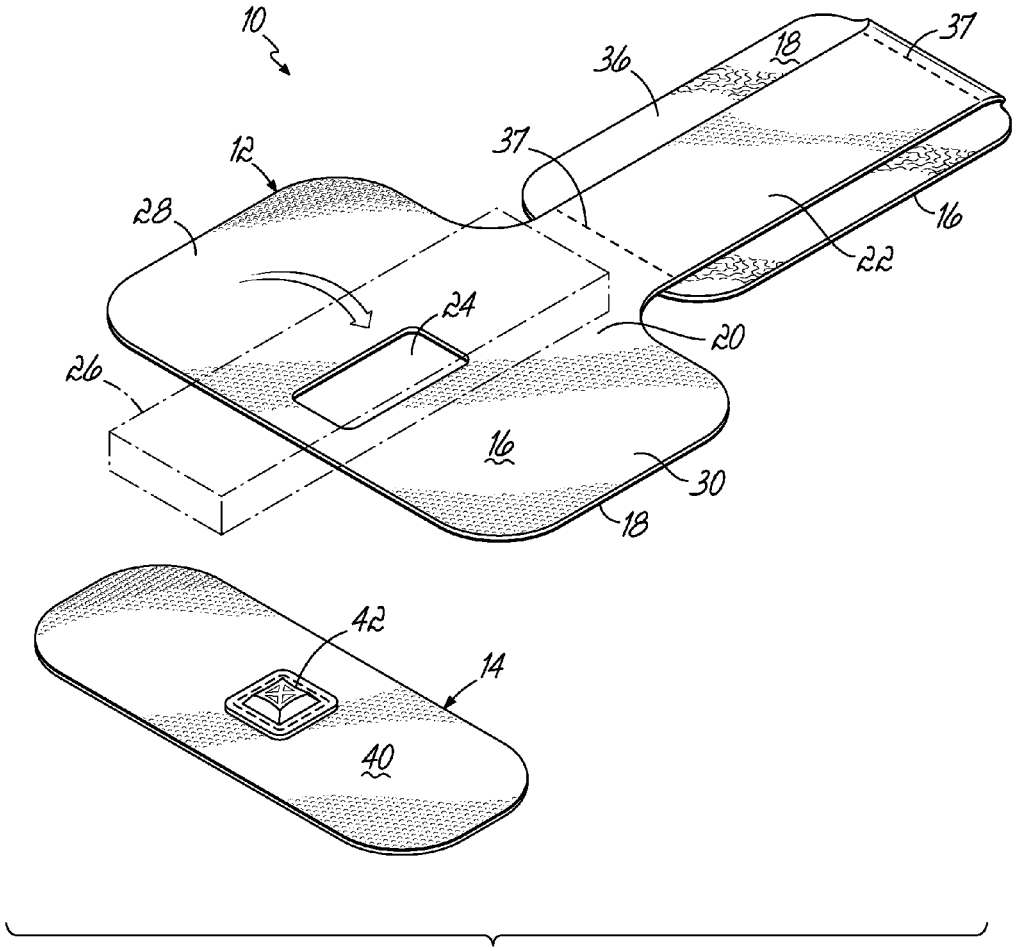
FIG. 1 illustrates the components of one embodiment of the invention and a first step in the configuration of the holster.

Referring to the various figures of the drawing, and first to FIG. 1, therein are illustrated the components of a holster 10 according to a first embodiment of the invention, including a first flexible sheet 12 and a retention member 14. The flexible sheet 12 has a first surface 16 and an opposite second surface 18. The first surface 16 is substantially covered with one fastener component of a hook-and-loop fastener material, in this case the hook component. The second surface 18 is substantially covered with the other fastener component of a hook-and-loop fastener material, in this case the loop component. Appropriate fabrics or materials may be sewn together or laminated as a single web, such as VELCRO® brand ONE-WRAP® available from Velcro USA, Inc., Manchester, N.H. The sheet 12 includes a first panel 20 and a second panel 22, which may extend from an edge of the first panel 20. The first panel 20 includes a window or aperture 24 formed therein that is positioned to expose a portion of the outer surface of an object 26 to be held by the holster 10. The object 26 may be any item desired to be held in a position for ready access, but secure against unintended displacement from the holster 10. The object 26 in the illustrated embodiment could be, for example, an ammunition magazine or flash light and the exact size and shape of the flexible sheet 12 is selected such that it will be useful with objects 26 of a predetermined range of sizes and shapes. Different generic, but relative, sizes, such as small/medium/large, may be provided to accommodate a variety of objects 26 likely to be held. Alternatively, a somewhat more particular size and shape sheet 12 may be provided to accommodate a more particular type of item, such as a knife or hand gun, the category of which may comprise a variety of specific sizes over a limited range. Use and placement of the retention member 14 will be described separately, below.

Figure 2A:
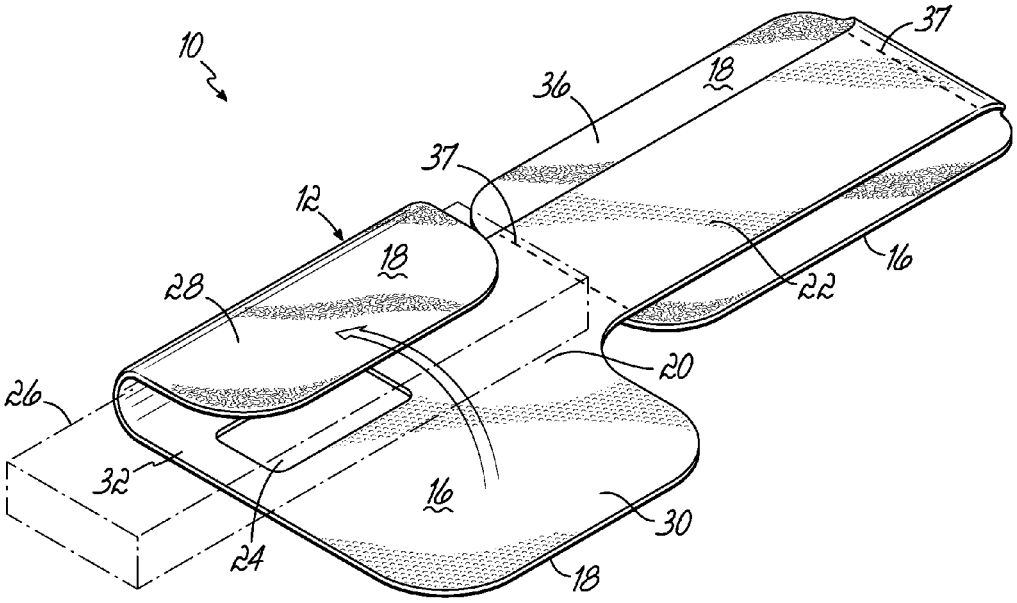
FIG. 2A illustrates a second step in the configuration.
Figure 2B:
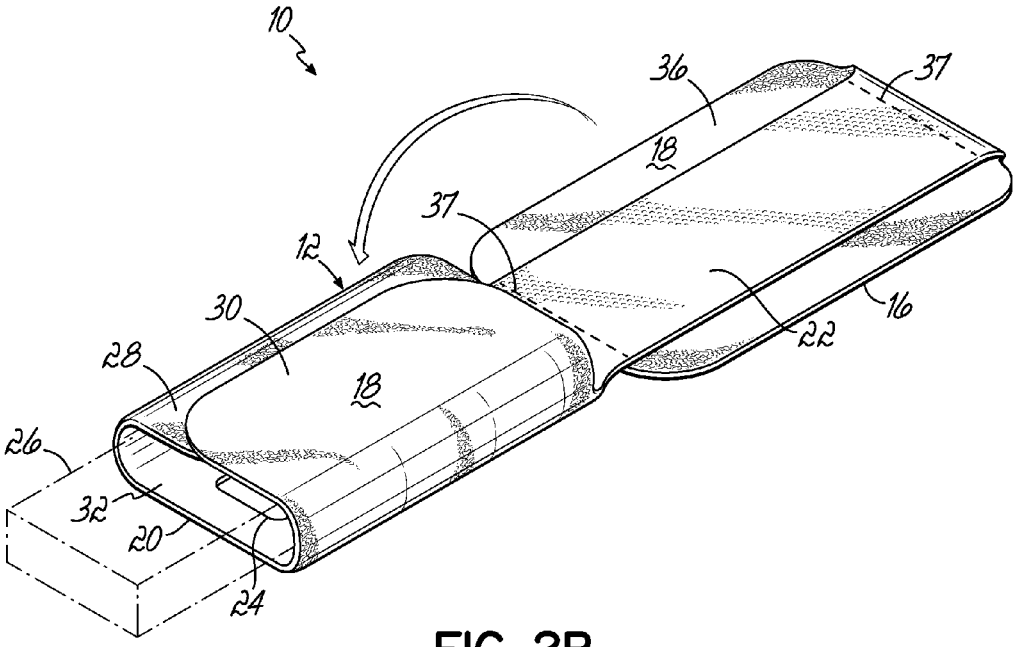
FIG. 2B illustrates a third step in the configuration.

Referring now also to FIGS. 2A-2D, the manner in which the holster 10 is assembled or configured will be explained. As shown in FIG. 1, the object 26 to be held by the holster 10 is positioned approximately in the center of the first panel 20. Typically, a portion of the object 26 would be situated to extend out of the holster 10 so that it may be gripped for withdrawal from the holster 10. A first end or wing 28 of the first panel 20 is folded over the object 26 (as shown by the arrow in FIG. 1). Referring to FIG. 2A, the second end or wing 30 of the first panel 20 is then folded over the object 26 (as shown by the arrow in FIG. 2A). Preferably, the two wings 28, 30 will partially overlap (as shown in FIG. 2B). Because opposite surfaces 16, 18 of the panel 20 come into contact with each other, the complimentary hook members and loop members engage to releasably secure the first panel 20 around the object 26. This creates a pocket for the object 26 with a portion extending outwardly that may be grasped for withdraw from the open end 32.

Figure 2C:
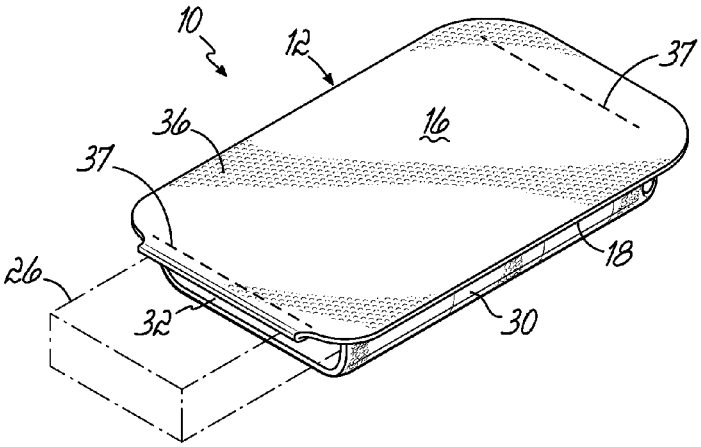
FIG. 2C illustrates the configuration after the fourth step.

As evident from the drawing figures, the range of sizes and shapes may be adjustably accommodated by wrapping the wings 28, 30 of the first panel 20. By using a larger or smaller first panel 20, objects 26 of other sizes and shapes beyond the illustrated range may also be accommodated. As shown in FIGS. 2B and 2C, the second panel 22 may be folded over to provide an opposite, closed end 34. If the wings 28, 30 do not overlap, the second panel 22 can secure the ends of the wings 28, 30 together.

The illustrated embodiment provides an optional attachment panel 36. The attachment panel 36 may be a separate sheet of material or may be an integral extension of the second panel 22 that is folded over and secured in place such as by stitching 37. In the illustrated embodiment, this attachment panel 36 functions in two distinct ways. First, it provides a passageway or loop 38 through which a belt or other strap (not shown) may be inserted. Second, because an opposite hook surface 16 is exposed on the outer side of the attachment panel 36, the assembled holster unit 10 may be releasably attached to another article, such as a backpack or vest, that has a complimentary surface of the loop components of a hook-and-loop fastener material. If the attachment panel 36 is formed from a separate sheet of material, surfaces having the hook component of a hook-and-loop fastener may be provided on both sides (not shown). In this alternate form, the hook component surface would adhere to the exterior, loop components surface of the second panel 22 as well as the loop component on the surface of a separate article. This alternate form would not provide a passageway or loop 38, unless a portion of the surface facing the second panel 22 is left the void of the hook component fastener material.

Figure 2D:
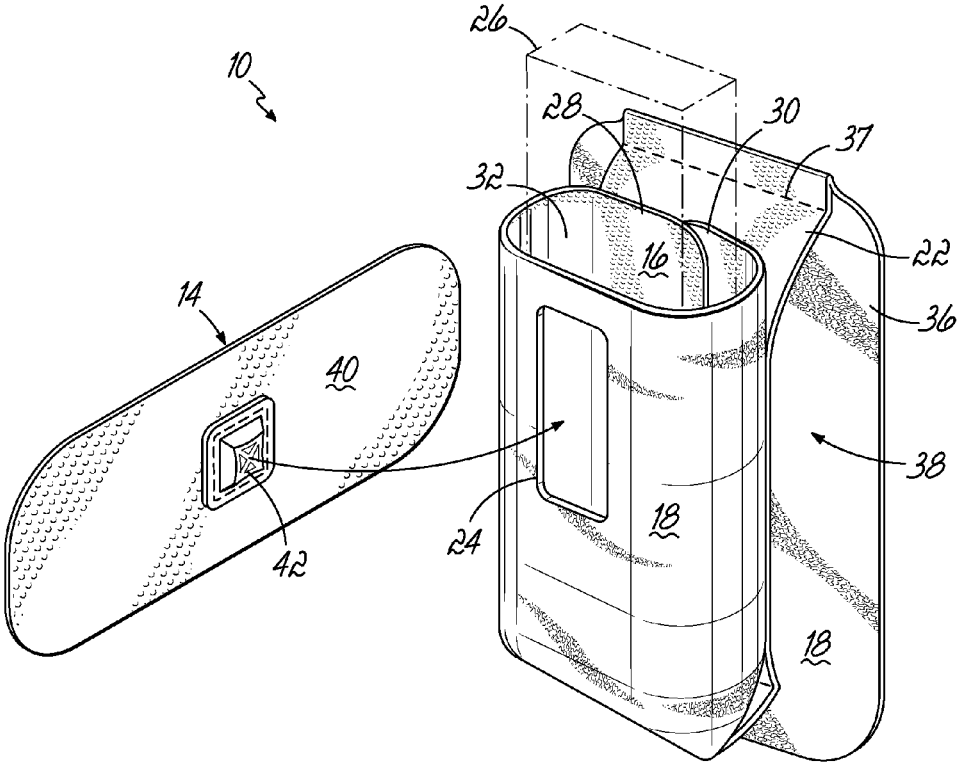
FIG. 2D illustrates a friction member being configured to the holster.

Referring now specifically to FIG. 2D, therein it can be seen that a portion of the surface of the object 26 being held in the holster 10 is exposed through the aperture 24. The retention member 14 may be formed of a flexible sheet of material having a surface substantially covered with the hook component of a hook-and-loop fastener material, like the flexible sheet 12. The retention member 14 also includes a friction member 42 positioned on this surface 40. The friction member 42 may be made of a material having a relatively higher coefficient of friction, such as rubber, PVC, or neoprene. Alternatively, the friction member 42 may present a three dimensional protrusion that can be positioned to extend through the aperture 24 and mechanically engage a recess or other profile of the object 26 being held. In either case, when the retention member 14 is secured to the outer surface 18 of the first 20 with the friction member 42 aligned over the aperture 24, a frictional interface between the friction member 42 and a surface of the object 26 acts to retain the object 26 against unattended withdrawal from the pocket of the holster 10. Typically, the retention member 14 is sized to completely cover the aperture 24, although this is not essential to the invention. Because the retention member 14 is repositionable over the aperture 24 of the folded sheet 12, the force with which the friction member 42 bears against the object 26 is adjustable.

Figure 2E:
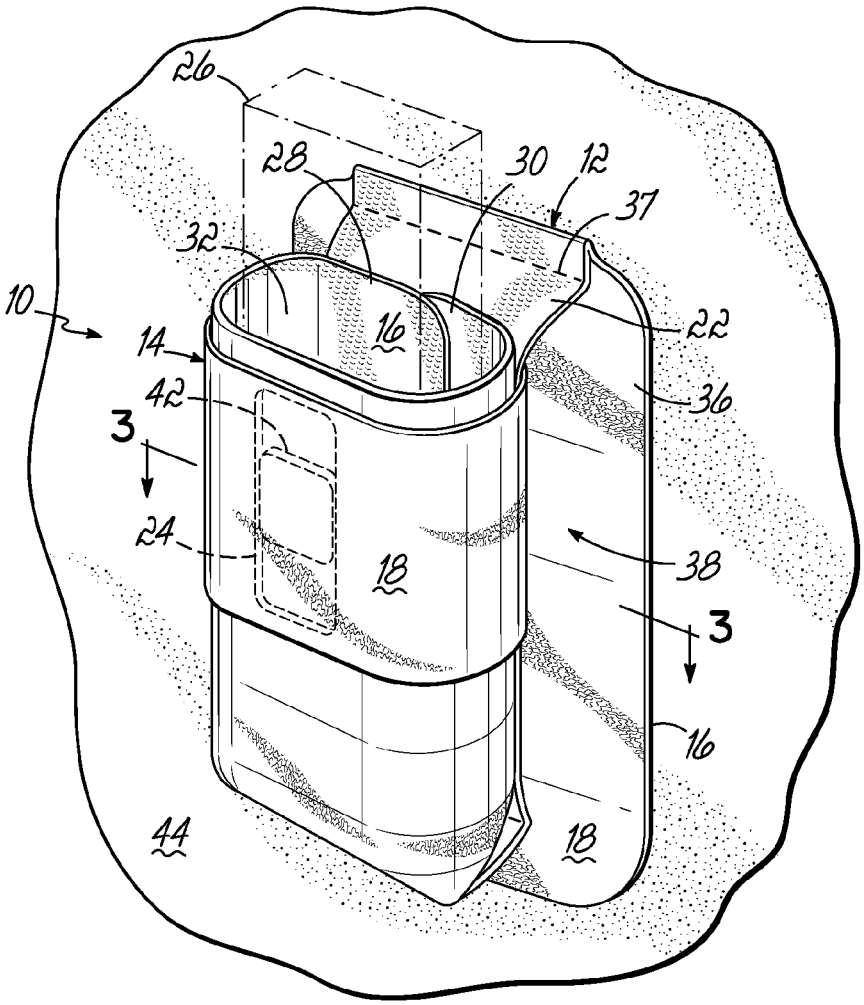
FIG. 2E illustrates the holster of this embodiment fully configured and attached to a surface of another article.
Figure 3:
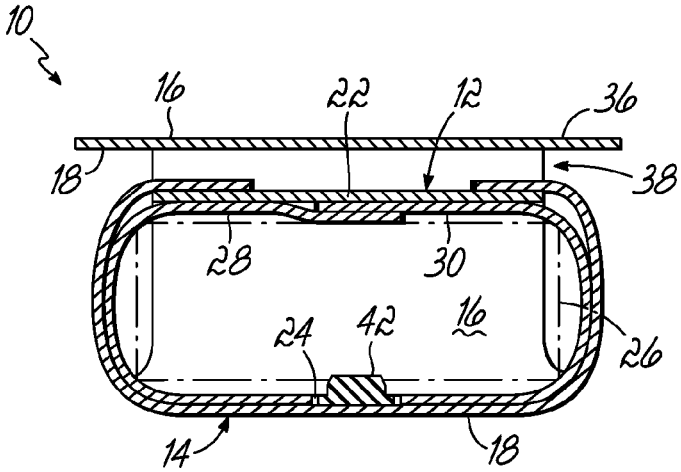
FIG. 3 is a cross-sectional view taken substantially along line 3-3 of FIG. 2E.
Figure 4:
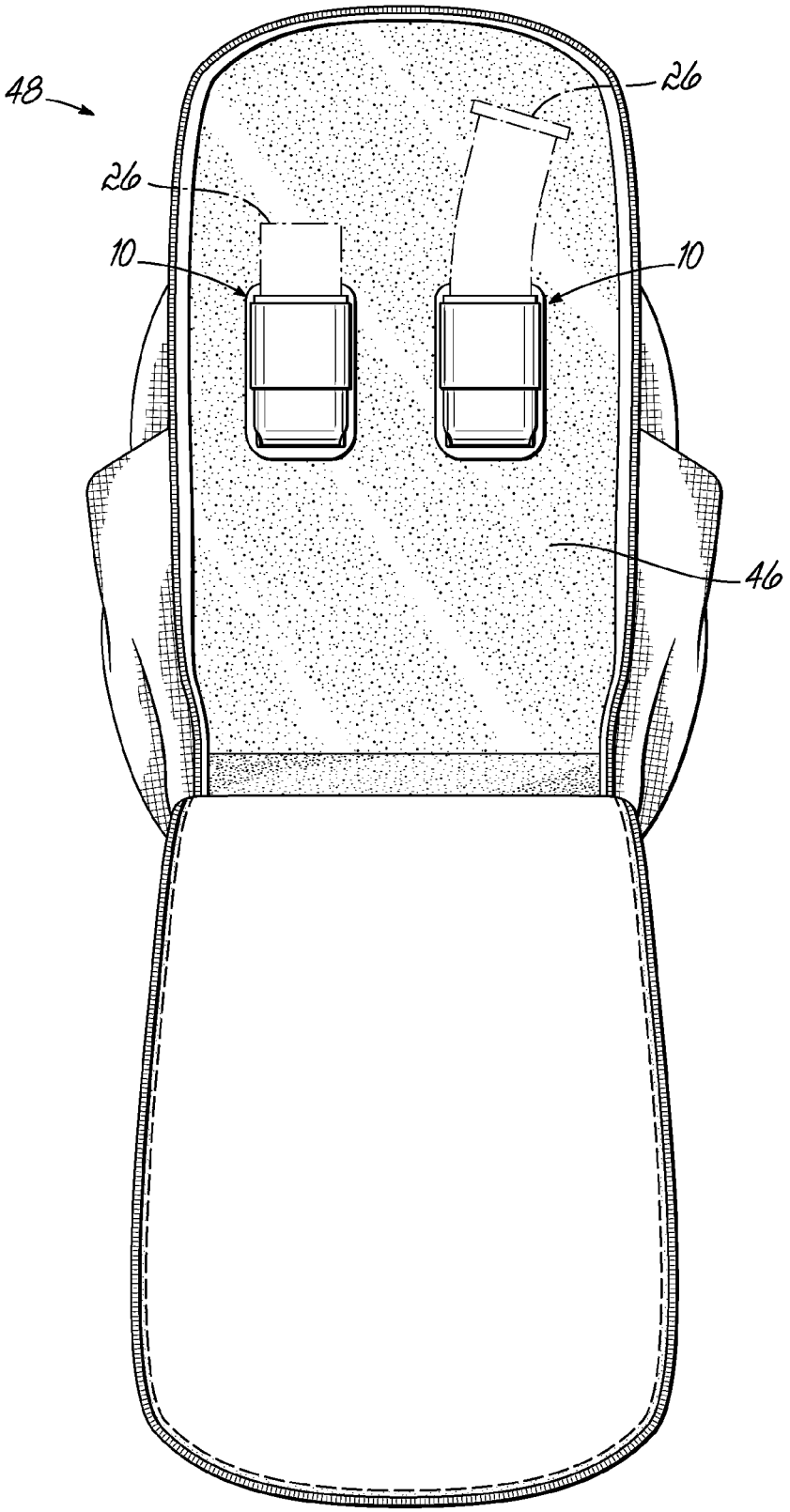
FIG. 4 illustrates two holsters of this embodiment fully configured and repositionably attached to an interior surface of a backpack.

As shown in FIG. 2E, the holster 10 may be removably and selectively positioned onto a surface 44 that is substantially covered with an engageable component (in this case, the loop component) of a hook-and-loop fastener material. FIG. 4 shows how the holster 10 may be positioned on an interior surface 46 of a backpack 48.

A variation of this holster embodiment 10 when an attachment panel 36 is used may be configured by folding the second panel 22 and attachment panel 36 in the direction opposite that shown in FIG. 2B. This provides an open-ended sleeve, rather than a closed-end pocket, to accommodate objects such as a long flashlight or baton, while still providing the passageway 38 for a belt or hook surface 16 for attachment to the surface of another article (such as interior surface 46 of a backpack 48).

Figure 5A:
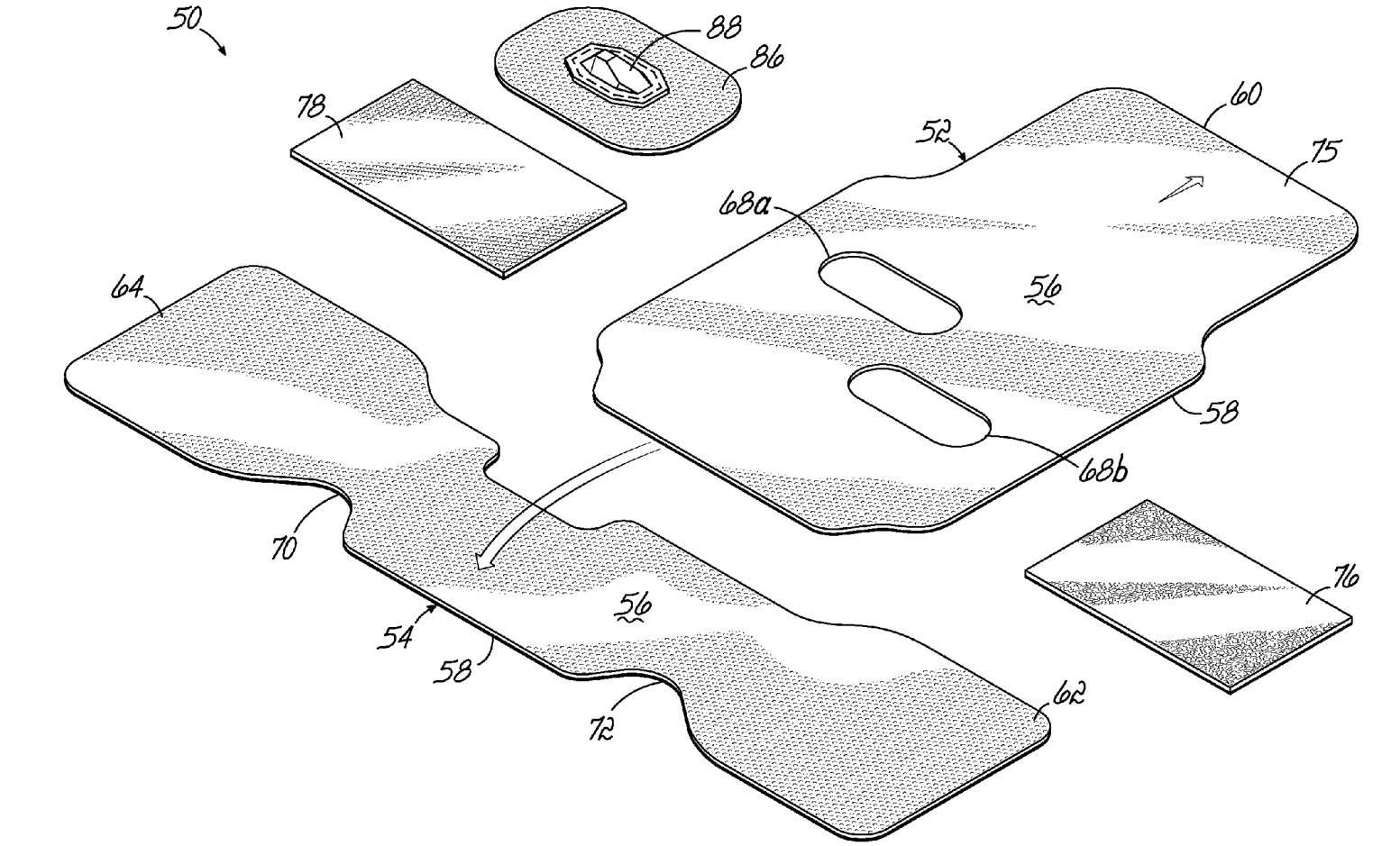
FIG. 5A illustrates the component parts of a second embodiment of the invention and a first step in the configuration of the holster.

Referring now to FIG. 5A, therein are illustrated the components of a configurable holster 50 according to a second embodiment of the invention, including a first flexible sheet 52 and a second flexible sheet 54. Like those previously described, each of these sheets 52, 54 are made from a material having a first surface 56 substantially covered with the hook component of a hook-and-loop fastener material and a second, opposite surface 58 substantially covered with the loop component of a hook-and-loop fastener material.

Figure 5B:
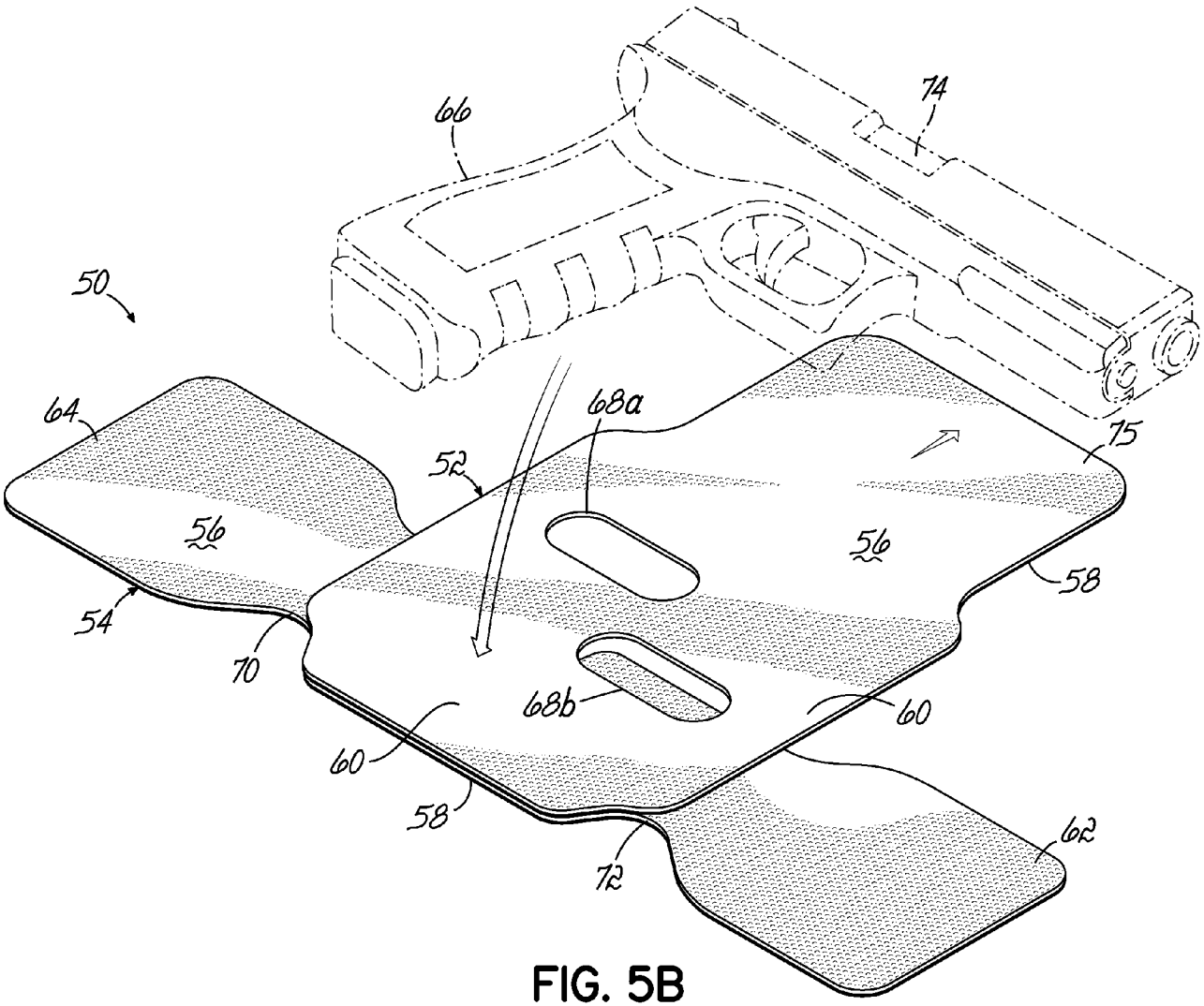
FIG. 5B illustration the positioning of a handgun for which the holster is to be configured in a second step in the configuration of the holster.

As shown in FIGS. 5A and 5B, the first sheet 52 is placed on and removably adhered to the second sheet 54 to provide a substantially unified member. The two sheets 52, 54 could be made from a single sheet of material, if desired. By providing the separately positionable sheets 52, 54 that may be assembled together in more than one configuration, however, the holster 50 of this embodiment may be assembled in a wider variety of configurations, as will be described in further detail below.

As shown in FIG. 5B, the first flexible sheet 52 and portion of the second flexible sheet 54 that is overlaid by the first sheet 52 provides a first panel 60. Portions of the second sheet 54 that extend outwardly beyond the first sheet 52 provide second and third panels 62, 64. This embodiment is particularly suited for configuration into a holster 50 for a handgun 66. The first panel 60 includes one or more apertures 68*a*, 68*b*. Although only one aperture 68*a*, 68*b* is needed and will be used, alternative locations provide a wider range of adaptability to various handgun shapes and sizes, as well as allowing the holster 50 to be configured in a left-hand or right-hand version. The unified first panel 60 (made of the overlapping first and second flexible sheets 52, 54) may have an exterior profile that includes one or more cut-away portions 70, 72 near where the first panel 60 is conjoined with the second and third panels 62, 64, respectively. The purpose of these cut-away portions 70, 72 will be explained separately, below.

Figure 5C:
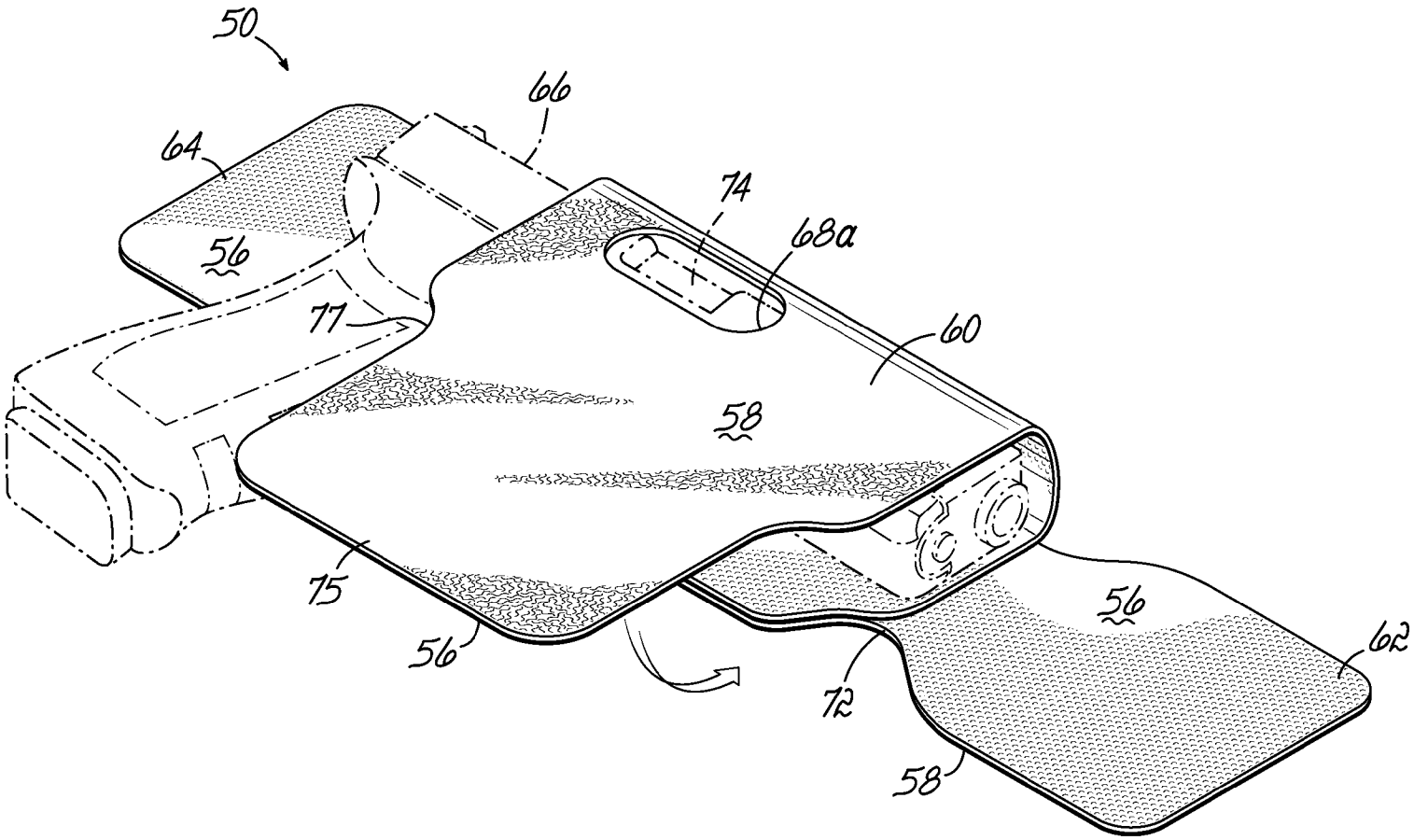
FIG. 5C illustrates a third step in the configuration of the holster.
Figure 5D:
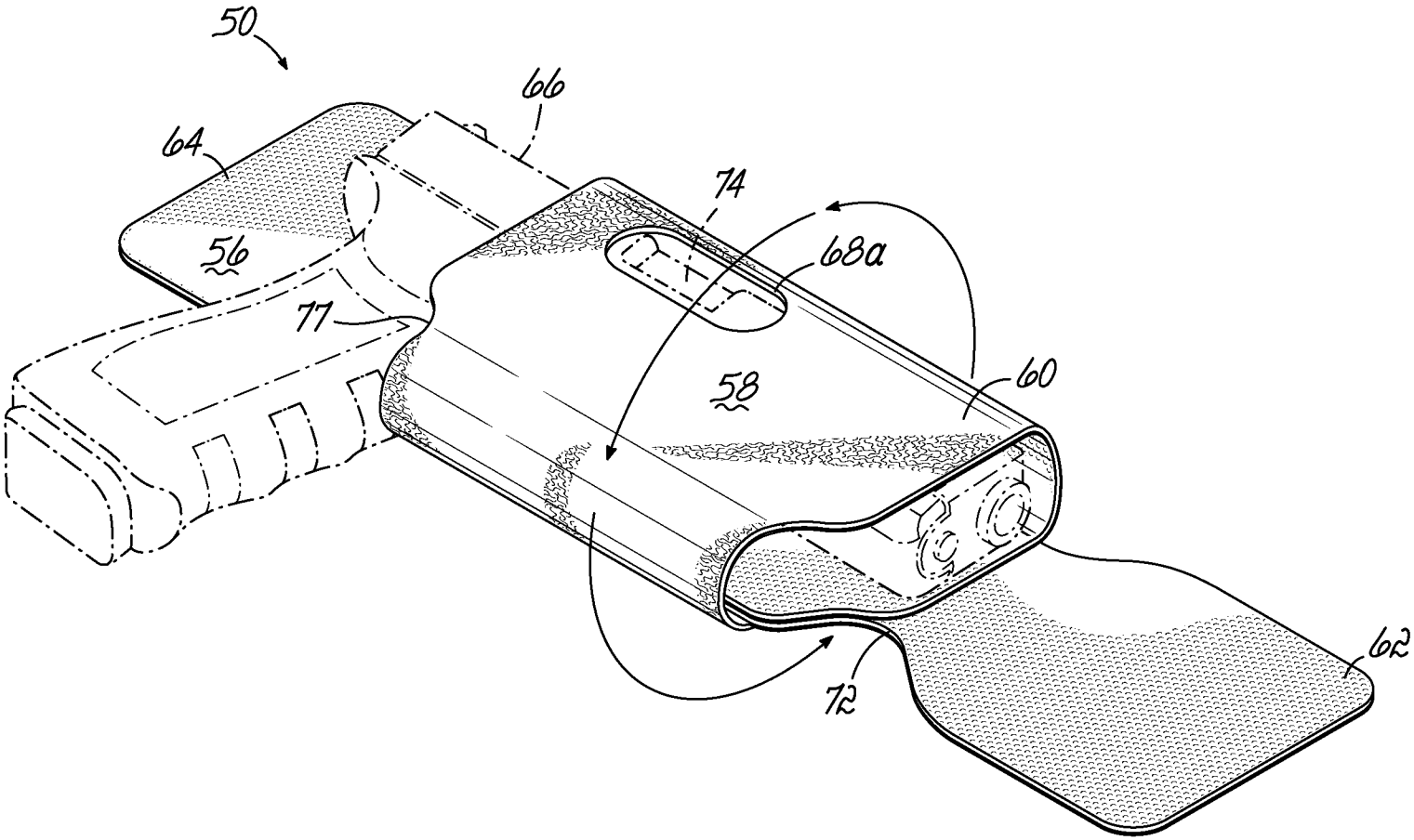
FIG. 5D illustrates a fourth step in the configuration of the holster.

As shown particularly in FIGS. 5B-5D, the handgun 66 or other object for which the holster 50 is being specifically configured may be used as a form around which the panels 60, 62, 64 are folded, wrapped, and assembled. As shown in FIG. 5C, the first panel 60 is wrapped over the top edge of the handgun 66 such that one of the apertures 68*a* is positioned to expose the ejection port 74 of the handgun 66. Although the exact size and location of the ejection port 74 may vary on different handguns 66, every semi-automatic handgun (pistol) typically carried for self defense has an ejection port located on the right-hand side of the slide adjacent the upper edge.

As mentioned above, the provision of an alternate aperture 68*b* at a different location in the first panel 60 allows the holster 50 of this embodiment to accommodate and be adaptable to a variety of handgun models and to be configured for either right-hand or left-hand draw. If the holster 50 is to be configured for a left-handed draw, the handgun 66 would be positioned with the muzzle pointing in the opposite direction of that shown in FIGS. 5B and 5C. In that case, the other aperture 68*b* would be positioned over the ejection port 74.

Figure 5E:
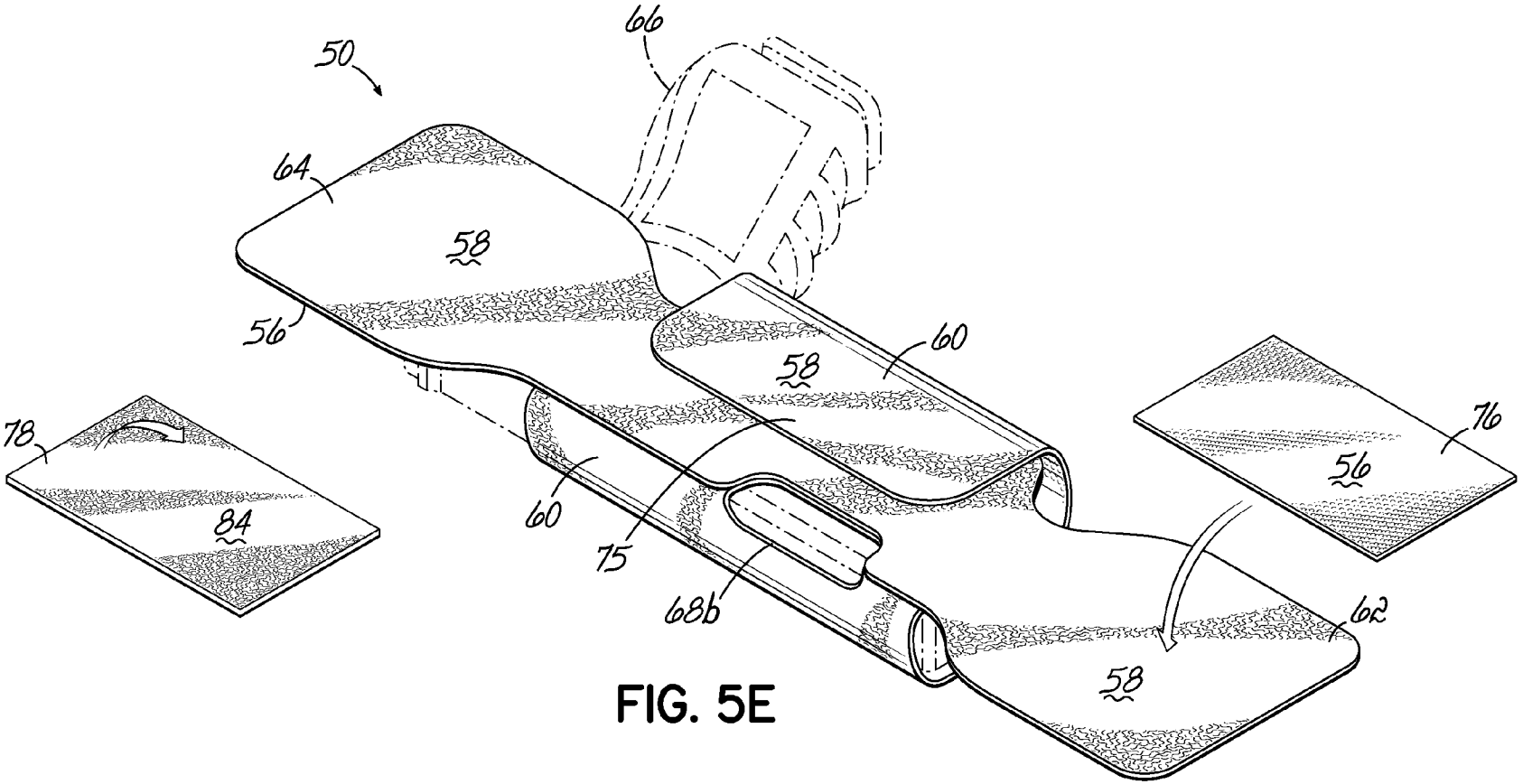
FIG. 5E illustrates a fifth step in the configuration of the holster.

Referring now to FIGS. 5D and 5E, the first panel continues wrapping around the handgun 66 to engage and adhere to itself through hook-and-loop fastening on the opposite side, providing a sleeve, open at both ends, custom fitted by the user to a handgun 66 of choice. The cut-away portions 70, 72, in combination with a narrowing of the free end 75 of the first panel 60 provide a "notch" 77 that fits the grip of the handgun 66 while enclosing most of the remaining area (in either right- or left-handed configurations).

Final assembly of the holster 50 from this stage may be accomplished according to more than one optional configuration. An example final configuration is illustrated in FIGS. 5E-5H. Alternate configurations will be described thereafter.

Figure 5F:
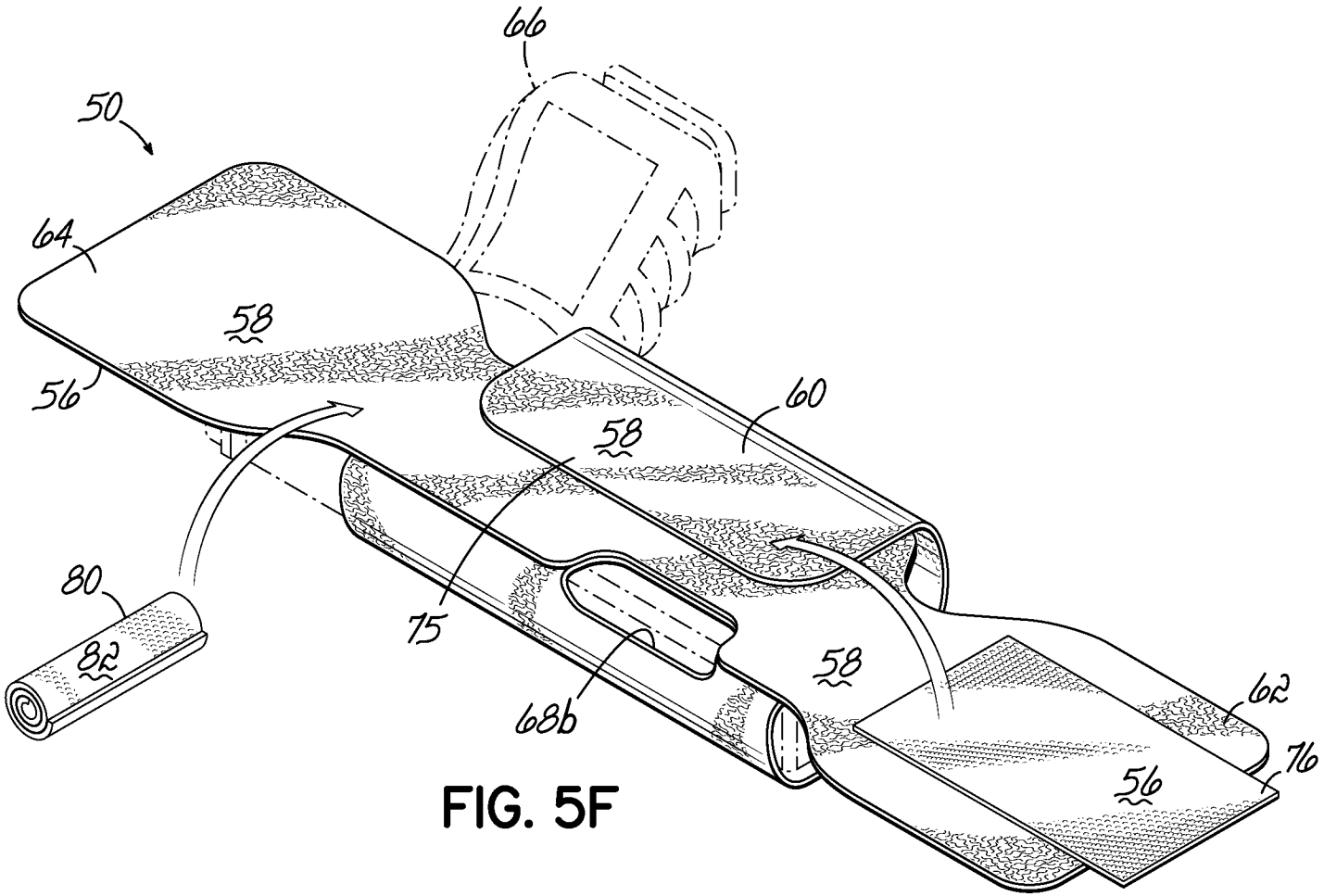
FIG. 5F illustrates a sixth step in the configuration of the holster.
Figure 5G:
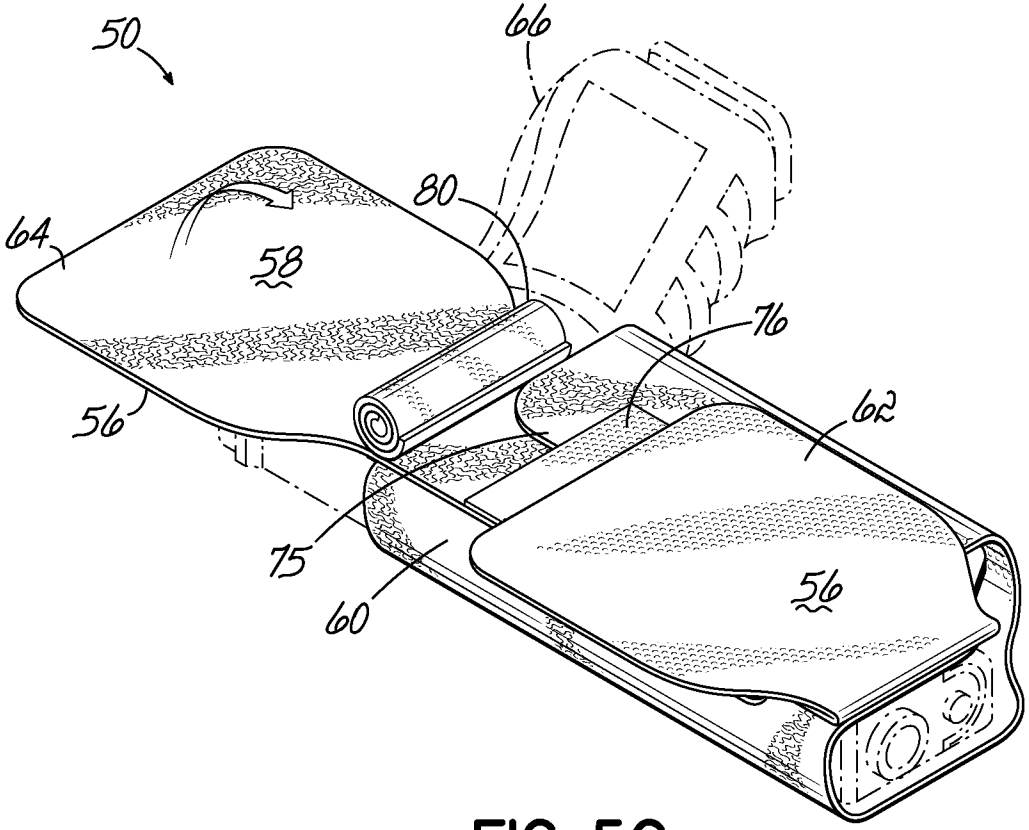
FIG. 5G illustrates a seventh step in the configuration of the holster.
Figure 5H:
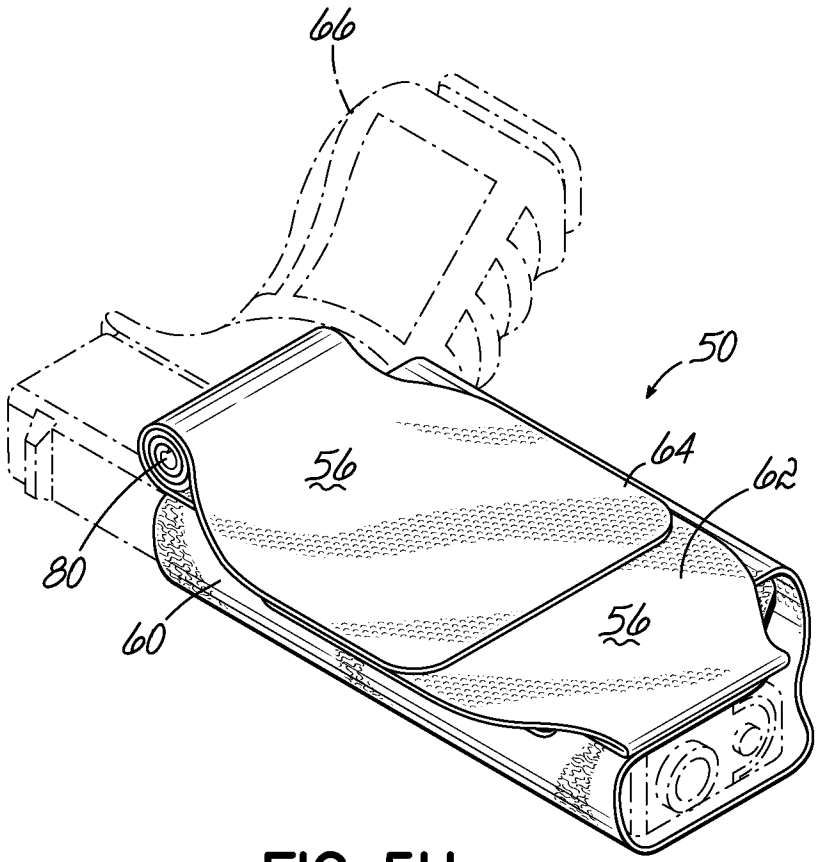
FIG. 5H illustrates an eighth step in the configuration of the holster.
Figure 51:
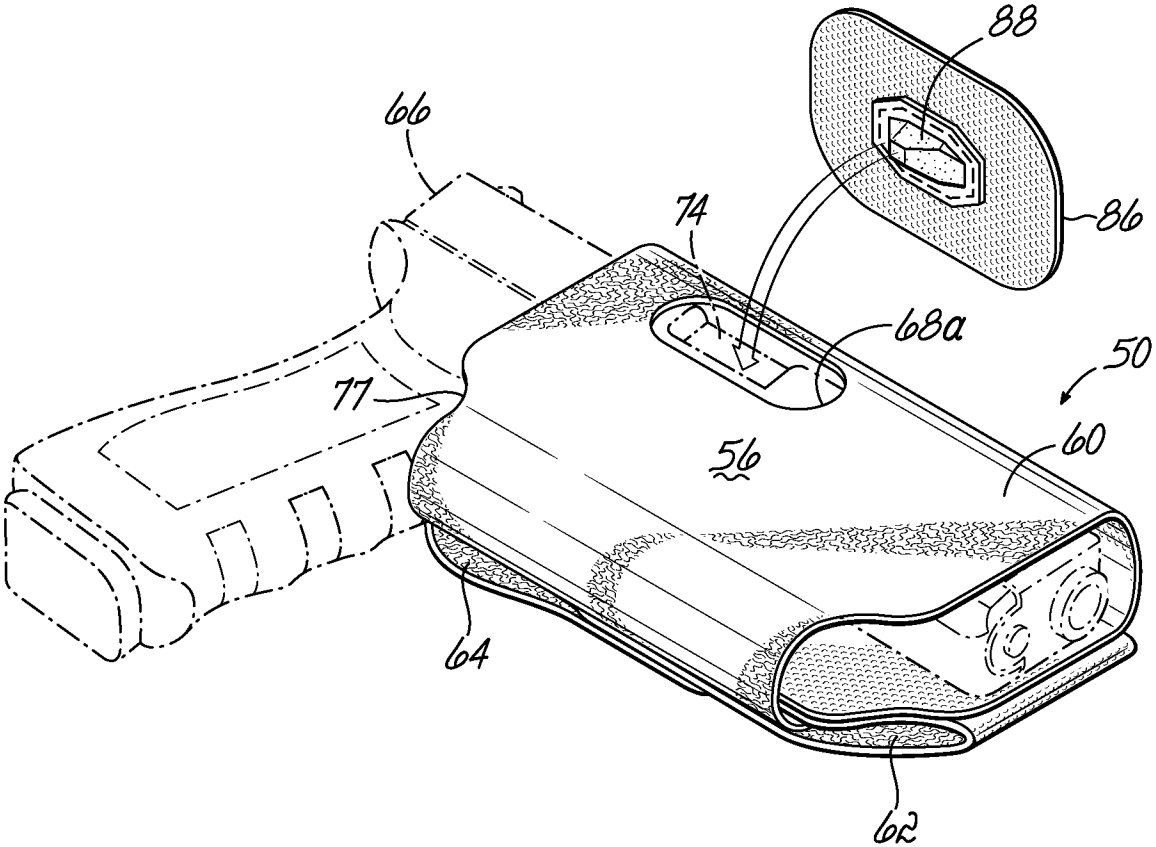

As shown in FIG. 5E, an attachment panel 76, having hook components of a hook-and-loop fastener material on both surfaces thereof, may be applied to the loop surface 58 of the second panel 52. Separately, another panel 78 formed from a similar flexible, two-sided sheet covered with hook fastener components on one side and loop fastener components on the other side is provided, as shown in FIGS. 5E and 5F. This panel 78 is rolled to create a spacer roll 80. As the panel 78 is rolled, hook components on one surface 82 interfaces with the loop surface 84 on the opposite side, causing the panel to maintain a rolled (80) configuration, as shown in FIGS. 5F and 5G. The spacer roll 80 may be positioned approximately along the boundary between the first panel 60 and third panel 64. Second panel 62, along with attachment panel 76 may be folded (as shown by the arrow in FIG. 5F) and adhered to the back surface of the sleeve formed by the first panel 60. As shown in FIG. 5G, the third panel 64 is then folded over the spacer roll 80 so that the loop surface 58 of the third panel 64 adheres to the hook surface 56 of the second panel 62 and attachment panel 76. The final configuration of this stage is shown in FIG. 5H. The optional spacer roll 80 provides an offset for the grip of the handgun 66 when the holster is attached to the surface of another article.

Referring again to FIG. 5E, alternate configurations include applying the attachment panel 76 to the third panel 64, rather than the second panel 62, and folding the second panel over the muzzle of the handgun 66 to provide a closed-end pocket, rather than an open-ended sleeve. Another alternate configuration is to fold both the second and third panels 62, 64 against the back of the first panel 60, overlying one another. This will allow the hook component surface 56 on one of the panels 62, 64 to adhere to the loop component surface 58 of the other panel 62, 64. This configuration provides a loop (albeit a large one) through which a belt or other strap may be inserted, while presenting an outwardly directed hook surface 56, which can be used to attached the holster 50 to the surface of another article. If the second panel 62 is folded over the muzzle end of the handgun 66 to provide a closed end, the third panel 64 can still be attached to the first panel 60 using the attachment panel 76 (with or without the spacer roll 80) in a manner that provides a more narrow passageway or belt loop, while still presenting an outwardly directed hook surface 56, which can be used to attached the holster 50 to the surface of another article.

Figure 5J:
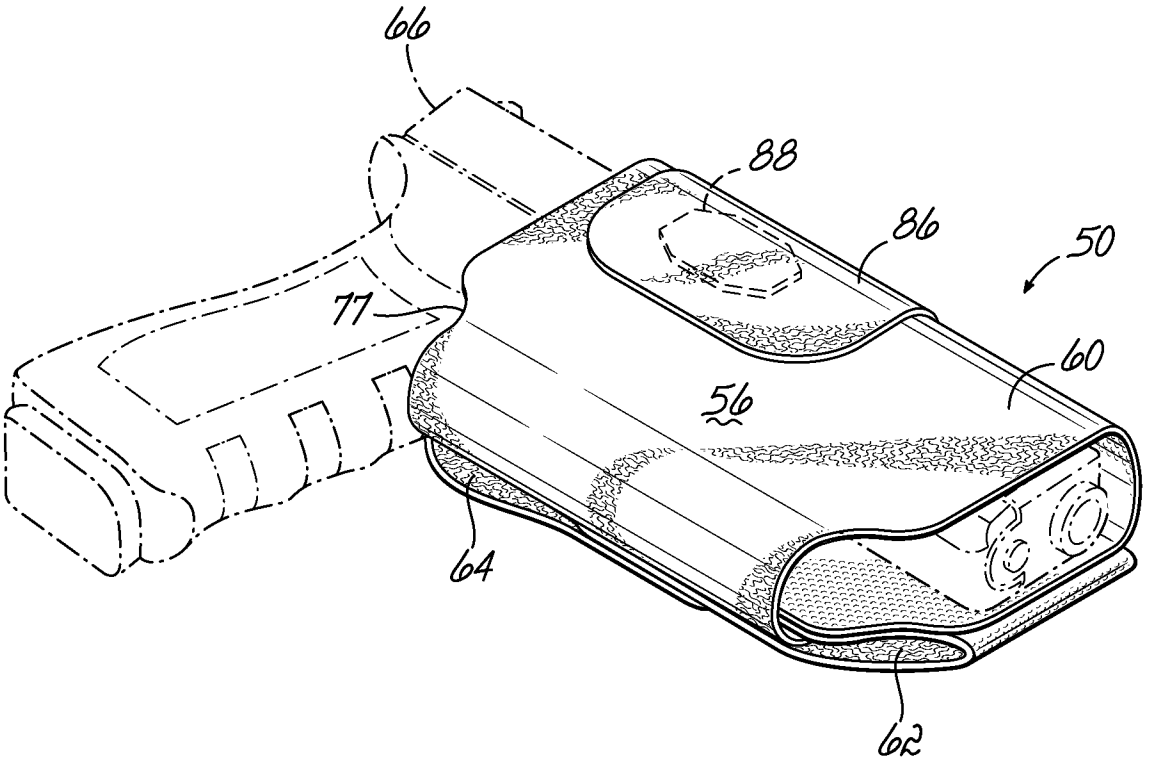
FIG. 5J illustrates the holster of this embodiment fully configured.

Referring now to FIGS. 5I and 5J, final assembly of the holster 50 is completed by application of the retention member 86 which carries a friction member 88 over the aperture 68. As described above, the friction member can be a simple patch of rubber or other material that provides an area with an increased coefficient of friction against which the handgun 66 must rub as it is withdrawn from the holster 50. Alternatively, the friction member 88 can be a three-dimensional detent that engages a recess in the handgun 66 provided by the ejection port 74. Optionally, the friction member may have a ramp shape that can be position to facilitate insertion of the handgun 66 into the holster 50 while inhibiting withdrawal, or vice-versa. Because the retention member 86 is repositionable over the aperture 68, the force with which the friction member 88 bears against the object or handgun 66 is adjustable.

The invention may comprise any number of panels, cut and provided with any suitable form of surface fasteners for connection together to snugly wrap and precisely fit a wide variety of articles, while being releasable for refitting to other articles of varying dimension, shape and size with similar secure fit, providing a user-formed holster or carrier confirmed to the shape of an article more precisely and advantageously than previously available devices non-conformable by the user. Panel size and shape variations are easily provided to accommodate larger or longer weapons or weapons with lights mounted thereto.

It will also be appreciated that any suitable form of yieldable or releasable surface mounted fasteners equivalent in function to hook-and-loop fasteners could be advantageously used. Moreover, a variety of panels in size, shape and number could be used. Further, in some embodiments of the invention, certain regions of a given surface may include hook components, while adjacent regions may include loop components (or other pairs of complementary mating components). Also, it will be appreciated that the juxtaposition of any component of the hook-and-loop fasteners can be switched or reversed, and that such fasteners could be limited on a surface of any panel only to the area needed to provide the universal configuration range desired.

While the illustrations demonstrate a somewhat simplified illustration of the connection between the panel and the receiving article, in some embodiments of the invention, additional joining fasteners or straps may be employed. Further, in some embodiments of the invention, the panel may be mated to the receiving article by way of interleaved straps or joining fasteners. Additionally, in some embodiments, straps or joining fasteners may be woven and passed through the panel or receiving article at a plurality of locations to improve the rigidity of the spatial relationship between the panel and the receiving article.

While exemplary embodiments of the present invention have been illustrated and described in detail, it should be apparent that other modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. A holster configurable and reconfigurable to hold different objects, comprising:

a first flexible sheet having first and second surfaces and an aperture therein, one surface of the first flexible sheet being substantially covered with one fastener component of a hook-and-loop fastener material and the other surface being substantially covered with the other fastener component of a hook-and-loop fastener material, the first flexible sheet being folded to form a sleeve sized to receive an object to be held; and a retention member attachable over at least a portion of the aperture, the retention member includes a flexible sheet being substantially covered with a hook fastener material and capable of wrapping around and attaching to at least a portion of the first flexible sheet and a protrusion that, through the aperture, contacts a surface of the object being held.

2. The holster of claim 1, further comprising an attachment panel secured to the first flexible sheet and having an exposed surface of one component of hook-and-loop fastener material.

3. The holster of claim 2, wherein the attachment panel is secured to the first flexible sheet at a spaced apart location to provide a passageway between the first flexible sheet and attachment panel.

4. The holster of claim 2, wherein the attachment panel is repositionably attachable to a surface of a separate article.

5. The holster of claim 4, further comprising a spacer positioned adjacent an open end of the sleeve to offset the open end from the surface of the separate article.

6. The holster of claim 1, wherein the first flexible sheet includes first and second interconnected panels, the first panel folded to form a sleeve sized to receive the object to be held and the second panel folded over to close an open end of the sleeve.

7. The holster of claim 6, further comprising an attachment panel secured to the first flexible sheet and having an exposed surface of one component of hook-and-loop fastener material.

8. The holster of claim 7, wherein the attachment panel is secured to the first flexible sheet at spaced apart location to provide a passageway between the first flexible sheet and the attachment panel.

9. The holster of claim 7, wherein the attachment panel is repositionably attachable to a surface of a separate article.

10. The holster of claim 1, wherein the protrusion creates a detent that mechanically interacts with a feature of the object.

11. The holster of claim 10, wherein the protrusion includes an angled surface that facilitates movement in the sleeve of the object in one direction and inhibits movement of the object in another direction.

12. A holster configurable and reconfigurable to hold different objects repositionably attachable to another article, comprising:

a first flexible sheet having first and second surfaces and an aperture therein, one surface of the first flexible sheet being substantially covered with one fastener component of a hook-and-loop fastener material and the other surface being substantially covered with the other fastener component of a hook-and-loop fastener material, the first flexible sheet being folded to form a sleeve sized to receive an object to be held;

a retention member attachable over at least a portion of the aperture, the retention member includes a flexible sheet being substantially covered with a hook fastener material and capable of wrapping around and attaching to at least a portion of the first flexible sheet and a protrusion that, through the aperture, contacts a surface of the object being held;

an attachment panel secured to the first flexible sheet and having an exposed surface of one component of hook-and-loop fastener material; and an article having a surface with a complementary component of hook-and-loop material to which the attachment panel is repositionably attachable.

* * * * *